US012161216B2

(12) United States Patent
Worcester

(10) Patent No.: US 12,161,216 B2
(45) Date of Patent: Dec. 10, 2024

(54) HYDRATION BLADDER REFILL SYSTEM WITHOUT BLADDER REMOVAL

(71) Applicant: Thomas Zachary Worcester, Nashville, TN (US)

(72) Inventor: Thomas Zachary Worcester, Nashville, TN (US)

( * ) Notice: Subject to any disclaimer, the term of this patent is extended or adjusted under 35 U.S.C. 154(b) by 101 days.

(21) Appl. No.: 18/072,288

(22) Filed: Nov. 30, 2022

(65) Prior Publication Data

US 2023/0100566 A1 Mar. 30, 2023

Related U.S. Application Data

(63) Continuation-in-part of application No. 16/390,895, filed on Apr. 22, 2019, now Pat. No. 11,540,614.

(51) Int. Cl.
*A45F 3/04* (2006.01)
*A45F 3/16* (2006.01)

(52) U.S. Cl.
CPC ..... *A45F 3/04* (2013.01); *A45F 3/16* (2013.01); *A45F 2003/166* (2013.01)

(58) Field of Classification Search
CPC ..... A45F 3/04; A45F 3/20; A45F 4/02; A45F 2003/166
USPC ..... 141/10, 114, 316; 224/148.2
See application file for complete search history.

(56) References Cited

U.S. PATENT DOCUMENTS 11,540,614 B2 * 1/2023 Worcester ..... A45F 3/20

* cited by examiner

*Primary Examiner* — Timothy L Maust

(57) ABSTRACT

In embodiments, the invention is a novel hydration pack refill system that comprises a fluid bladder, a bag for carrying the fluid bladder, a bladder nozzle for refilling the fluid bladder, a clip for sealing the end of the bladder nozzle, and a refill port for accessing the bladder nozzle through the bag and methods for its use. The invention may further comprise a water tube and a mouthpiece to allow a user to drink from the fluid bladder while wearing the bag. In an embodiment, the invention may employ one or more locking devices for holding the clip in place. The invention may further employ mating pairs of seating connectors to provide a watertight seal to the closed bladder nozzle.

12 Claims, 12 Drawing Sheets

HYDRATION BLADDER REFILL SYSTEM WITHOUT BLADDER REMOVAL

CLAIM TO PRIORITY

This application claims under 35 U.S.C. § 120, the benefit of the application Ser. No. 16/390,895, filed Apr. 22, 2019, titled "Novel Hydration Bladder Refill System Without Bladder Removal" which is hereby incorporated by reference in its entirety.

COPYRIGHT NOTICE

A portion of the disclosure of this patent document contains material which is subject to copyright protection. The copyright owner has no objection to the facsimile reproduction of the patent document or the patent disclosure, as it appears in the Patent and Trademark Office patent file or records, but otherwise reserves all copyright rights whatsoever.

BACKGROUND

The present invention relates to the field of hydration systems, more specifically, a hydration bladder refill system that may be refilled without bladder removal.

For many high-energy activities, hydration is a key area of interest regarding a sustained level of performance, ranging from running, to hiking, or even to dancing. Hydration bladders, and their accompanying packs or bags, have grown in popularity alongside the growth in segments of vigorous activity.

Over the past two decades, hydration packs have taken many different forms, with changes implemented in areas concerning the construction of the bladder and the construction of the nozzle that a user supplies water through. The form of these packs has been a constant area of innovation.

However, the vast majority of hydration packs hang vertically in their containers, in order to put the feed tube at the lowest possible point to create suction for the user to capture the flow of a fluid.

With a bladder hanging vertically, the process of refilling the bladder generally requires the removal of the bladder from the underlying bag or container in order to access the port that allows water to flow back into the fluid cavity.

However, some of the high-energy activities that require constant hydration that is provided by a hydration pack may be sensitive to the amount of time required to refill the fluid cavity. As a non-limiting example, a triathlete who is running an event in a hydration pack loses valuable time off of his race results if he stops to remove his bladder from his bag or container to refill the fluid cavity.

Additionally, once the bladder has been removed from the container or bag to be refilled, a user needs to either put the bag or container on the ground or hand the bag to another individual in order to have the dexterity to remove the cap or open the port for the entry point of the bladder to begin to refill the fluid cavity.

BRIEF SUMMARY OF THE INVENTION

A need exists in the field of personal hydration to minimize the total time a user needs to fully refill their hydration bladder in response to time-sensitive situations. A further need exists in the field of personal hydration such that the user dexterity required to refill a bladder does not require the separation of the bladder from the bag or container, which often requires the aid of another individual or the placement of the bag or container on another surface.

In an embodiment, the invention is a novel hydration pack refill system that comprises a fluid bladder, a bag for carrying the fluid bladder, a bladder nozzle for refilling the fluid bladder, a clip or other closure for sealing the end of the bladder nozzle, and a refill port for accessing the bladder nozzle through the bag and methods for its use. The invention may further comprise a water tube and a mouthpiece to allow a user to drink from the fluid bladder while wearing the bag. In preferred embodiments, the bag may be worn on a user's back, held in place by a pair of shoulder straps, and may be rapidly refilled by reorienting the bag from a vertical orientation to a horizontal orientation, opening the refill port, extending the bladder nozzle, removing the clip or other closure device to unseal the bladder nozzle, and refilling the fluid bladder via the bladder nozzle.

An object of the invention is to provide a hydration system for personal use.

Another object of the invention is to provide the ability to refill the fluid bladder of the hydration system without having to completely remove the hydration system from the user's back.

A further object of the invention is to provide a nozzle for refilling the bladder which is located on the side of the bladder and which becomes accessible on an upper surface of the hydration system via a refill port when the hydration system is reoriented. A nozzle may comprise any nozzle, port, or purpose-built ingress opening attached to a refill bladder to permit the ingress and egress of liquids to and from the refill bladder.

Yet another object of the invention is to provide a hydration system that may be reoriented from a vertical orientation to a horizontal orientation by removing one shoulder strap and suspending the hydration system from the remaining shoulder strap.

BRIEF DESCRIPTION OF THE DRAWINGS

Certain illustrative embodiments illustrating organization and method of operation, together with objects and advantages may be best understood by reference to the detailed description that follows taken in conjunction with the accompanying drawings in which.

DETAILED DESCRIPTION

Figure 1:
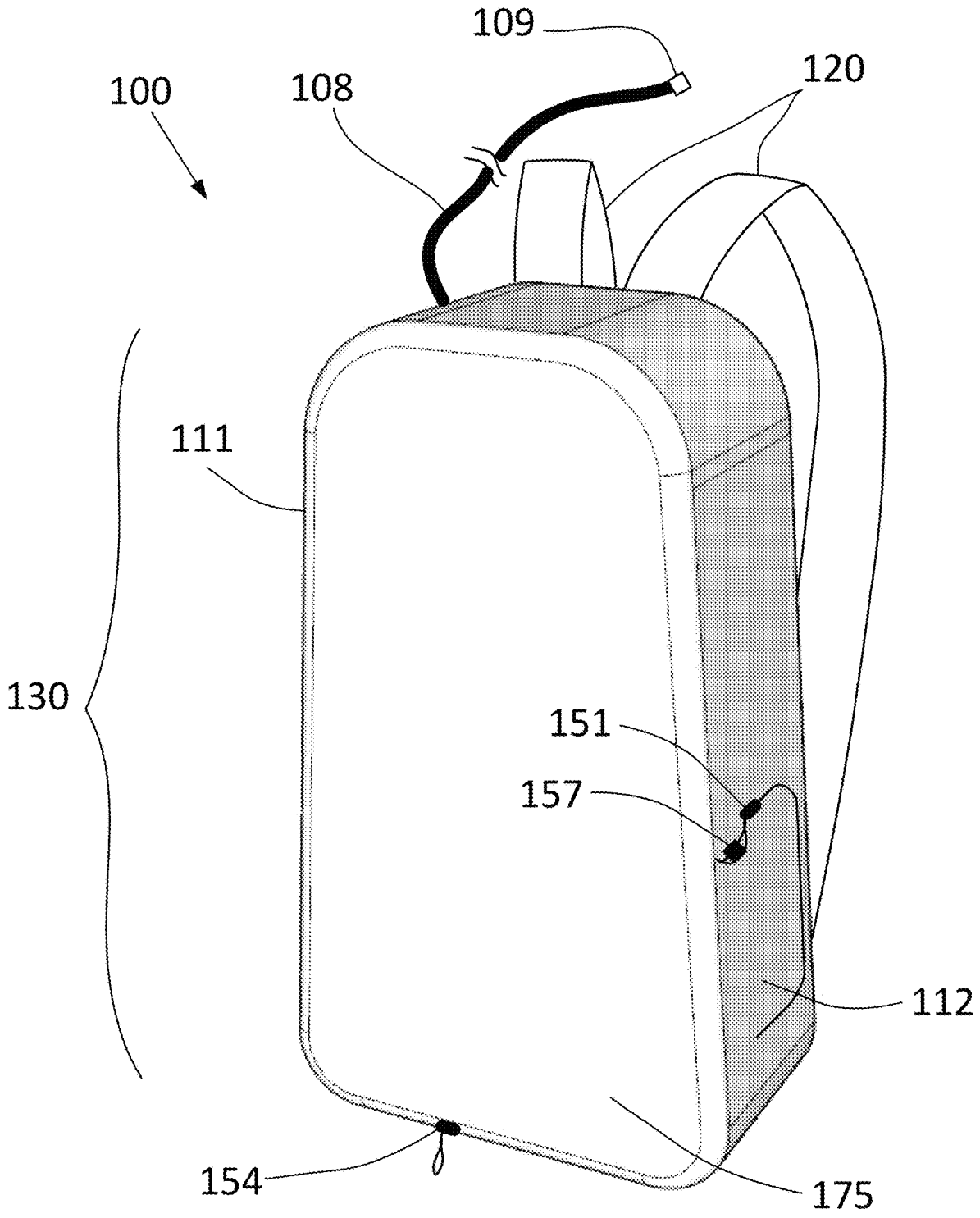
FIG. 1 depicts a perspective view of an embodiment of the invention.

While this invention is susceptible of embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings.

The terms "a" or "an", as used herein, are defined as one or more than one. The term "plurality", as used herein, is defined as two or more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "one embodiment", "certain embodiments", "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used in this disclosure, a "bag" is a container made of a flexible material. The bag has a single opening which allows the bag to receive the items to be contained.

As used in this disclosure, a "cavity" is an empty space or negative space that is formed within an object.

As used herein, the words "couple", "couples", "coupled" or "coupling", refer to connecting, either directly or indirectly, and does not necessarily imply a mechanical connection.

As used herein, the word "durable" refers to a material's ability to withstand wear, pressure, impact, heat, cold, sun exposure, and other forms of potentially damaging conditions without suffering any significant deterioration of quality or usability.

As used in this disclosure, a "fastener" is a device that is used to join or affix two objects. Fasteners generally comprise a first element which is attached to the first object and a second element which is attached to the second object such that the first element and the second element join to affix the first object and the second object. Common fasteners include, but are not limited to, hooks, zippers, snaps, clips, ties, buttons, buckles, quick release buckles, or hook and loop fasteners.

As used in this disclosure, "flexible" refers to an object or material which will deform when a force is applied to it, which will not return to its original shape when the deforming force is removed, and which may not retain the deformed shape caused by the deforming force.

As used herein, "front" indicates the side of an object that is closest to a forward direction of travel under normal use of the object or the side or part of an object that normally presents itself to view or that is normally used first. "Rear" or "back" refers to the side that is opposite the front.

As used in this disclosure, a "hook and loop fastener" is a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks fastens to the plurality of loops securely fastening the hook surface to the loop surface.

As used in this disclosure, "horizontal" is a directional term that refers to a direction that is perpendicular to the local force of gravity. Unless specifically noted in this disclosure, the horizontal direction is always perpendicular to the vertical direction.

As used in this disclosure, the word "interior" is used as a relational term that implies that an object is located or contained within the boundary of a structure or a space.

As used in this disclosure, "orientation" refers to the positioning and/or angular alignment of a first object relative to a second object or relative to a reference position or reference direction.

As used in this disclosure a "strap" is a strip of leather, cloth, nylon, plastic, thin metal, rubber, or other flexible material, that is used to fasten, secure, carry, or hold onto something. A strap is sometimes used in conjunction with a buckle.

As used herein, the word "substantially" indicates that two or more attributes are the same except for a margin of error related to variances in materials, manufacturing processes, craftsmanship, installation, environmental conditions, or other factors that may influence the attributes and that the differences introduced by these factors are not considered detrimental to the operation of the invention as described herein.

As used in this disclosure, "vertical" refers to a direction that is parallel to the local force of gravity. Unless specifically noted in this disclosure, the vertical direction is always perpendicular to horizontal.

As used herein, the word "watertight" refers to a barrier that is impermeable to water.

As used in this disclosure, a "zipper" is a fastening device comprising two flexible strips with interlocking components that are opened and closed by pulling a slide along the two flexible strips.

Throughout this document, directional references of "left" or "right" are given with respect to the orientation of the user. Specifically, "left" is on the same side as the user's left and "right" is on the same side as the user's right.

Throughout this document, a directional reference of "rear" refers to the side of the hydration system that touches the user's back. A directional reference of "front" refers to the side of the hydration system that is opposite "rear", which is also the side of the hydration system that is most visible to a person standing behind the user while the user is wearing the hydration system.

In embodiments, the invention is a novel hydration pack refill system that generally comprises the fluid bladder, the bag for carrying the fluid bladder, the bladder nozzle for refilling the fluid bladder, the clip for sealing the end of the bladder nozzle, and the refill port for accessing the bladder nozzle through the bag. The fluid bladder may be a flexible, watertight vessel for holding the fluid. As a non-limiting example, the fluid may be water or any other fluid used for human hydration purposes. The bladder nozzle for filling the fluid bladder with the fluid may be located on a right side or a left side of the bag or the bottom of the bag. An additional outlet for removing the fluid from the fluid bladder may be located at the bottom of the fluid bladder to maximize the amount of the fluid that may be removed from the fluid bladder.

The bag may be a container that houses the fluid bladder. In preferred embodiments, the bag may be made of a flexible, durable fabric. As a non-limiting example, the bag may be made of canvas, nylon, polyester, polypropylene, or combinations thereof. The bag may comprise the pair of shoulder straps. The top of a left strap may couple to the top of an upper compartment port on the left rear side of the bag. The bottom of the left strap may couple to the bottom of the bag on the left rear side of the bag. The top of a right strap may couple to the top of the upper compartment port on the right rear side of the bag. The bottom of the right strap may couple to the bottom of the bag on the right rear side of the bag. The user may wear the bag in the vertical orientation by sliding their arms through the left strap and through the right strap such that the bag rests on their back with the pair of shoulder straps passing over their shoulders.

The bag may be reoriented to the horizontal orientation for purpose of refilling by removing the strap from the arm that is on the side of the bag opposite the bladder nozzle and then swinging the bag on the remaining strap around the side of the user until the bag is suspended from one shoulder of the user with the bladder nozzle on the top of the reoriented bag.

The bag may comprise one or more compartments. One of the one or more compartments may be a bladder compartment for housing the fluid bladder. The bladder compartment may also be referred to as a lower compartment. The fluid bladder may be sized to fit within the bladder compartment. The fluid bladder may substantially fill the bladder compartment when the fluid bladder is filled with the fluid. The fluid bladder may be restrained within the bladder compartment by a bladder retention strap. The bladder retention strap may be vertically oriented within the bladder compartment. The top and bottom of the bladder retention strap may be coupled to the bag at the top and bottom of the bladder compartment such that the bladder retention strap may prevent the fluid bladder from falling out of the bag when a lower compartment port is opened. The bladder retention strap may retain the fluid bladder between the bladder retention strap and the front side of the bag. In some embodiments, the fluid bladder may be removed from the bladder compartment by stretching the bladder retention strap which is elastic, by decoupling the top of the bladder retention strap or the bottom of the bladder retention strap from the bag, or by decoupling a first strap portion from a second strap portion at a retention strap fastener. As a non-limiting example, the retention strap fastener may be a hook and loop fastener.

One of the one or more compartments may be an upper compartment which may provide a storage area within the bag.

The bag may comprise one or more fabric ports that provide access to the one or more compartments. One of the one or more fabric ports may be located adjacent to the bladder nozzle and may be designated as the refill port. The refill port may be opened to gain access to the bladder nozzle. The one or more fabric ports may also comprise the upper compartment port which provides access to the upper compartment when opened and the lower compartment port which provides access to the lower compartment when opened.

In some embodiments, the upper compartment port, the lower compartment port, or both may be padded for the comfort of the user. As a non-limiting example, the upper compartment port, the lower compartment port, or both may comprise five-layered foam.

The fluid bladder may comprise an inlet in the form of the bladder nozzle. The bladder nozzle may be the entry point for the fluid to flow into the fluid bladder. The bladder nozzle may be a hollow cylindrical extension of the fluid bladder on one side of the fluid bladder. The center of the bladder nozzle may open to the interior of the fluid bladder such that the fluid may flow into or out of the fluid bladder via the bladder nozzle. The bladder nozzle may be pressed flat, folded, and sealed by sliding the clip onto the fold of the bladder nozzle to prevent the flow of the fluid. The clip may be a mechanism that secures the bladder nozzle to prevent the flow of the fluid through the bladder nozzle in either direction. As non-limiting examples, the clip may be a slide clip, a locking seal, a screw top, or other form of seal. In some embodiments, the clip may press against both sizes of the folded nozzle and may compress the material of the bladder nozzle to create the friction that holds the clip in place.

The invention may further comprise the water tube and the mouthpiece to allow the user to drink from the fluid bladder while wearing the bag. The bottom of the water tube may couple to the fluid bladder at the outlet. The outlet may allow the fluid to flow from the fluid bladder into the water tube. The top of the water tube may couple to the mouthpiece. The water tube may pass through the one or more compartments within the bag and may exit the bag at the top of the bag. In some embodiments, the water tube may pass between layers of the side wall of the bag such that the water tube is not visible within some or all of the one or more compartments of the bag. The water tube may be placed over the user's shoulder such that the mouthpiece may be placed into the mouth of the user when the bag is in place on the user's back. The user may siphon the fluid from the fluid bladder into their mouth by placing the mouthpiece in their mouth and sucking on the mouthpiece.

The bag may normally be worn on the user's back in the vertical orientation, held in place by the pair of shoulder straps over the user's shoulders. The vertical orientation places the outlet at the bottom of the fluid bladder and places the mouthpiece at the top of the bag where it may be pulled to and placed in the mouth of the user. The bladder nozzle may be sealed closed by the clip while the bag is in the vertical orientation to prevent spilling the fluid. The bag may be reoriented to the horizontal orientation by slipping one arm out of a first shoulder strap on the side of the bag that is opposite the bladder nozzle and by swinging the bag under the arm using a second shoulder strap. This places the bag into the horizontal orientation where the bladder nozzle is at the top of the fluid bladder as the bag hangs from the second shoulder strap at the side of the user. While in the horizontal orientation, the refill port may be opened and the bladder nozzle may be used to refill the fluid bladder. To refill the fluid bladder, the bladder nozzle may be extended in an upward direction, the clip or other closure device may be removed, and the end of the bladder nozzle may be held open while the fluid is added. When the refilling operation is complete, the bladder nozzle may be flattened and folded and the clip or other closure device may be placed onto the bladder nozzle to secure the fold. The bladder nozzle may be placed back inside the bladder compartment, the refill port may be closed, and the first shoulder strap may be moved back to its original position over the user's shoulder.

In some embodiments, the bladder compartment may be lined with an insulating material to assist in retaining the fluid bladder at a constant temperature.

The pair of shoulder straps may be flexible bands of natural or synthetic material. As non-limiting examples, the pair of shoulder straps may be made of canvas, nylon, polypropylene, leather, or combinations thereof.

In some embodiments, the pair of shoulder straps may comprise one or more device pockets and a plurality of cable straps. One or more electronic devices may be placed into the device pockets and cables leading from the electronic devices may be routed through the plurality of cable straps. As a non-limiting example, electroluminescent wire, or EL wire, may be routed through the cable straps for decorative purposes and an EL wire driver may be placed into the device pocket. An individual cable strap selected from the plurality of cable straps may be a flexible strap coupled to the shoulder strap and oriented laterally across the shoulder strap. In some embodiments the cable strap may be elastic. The device pocket may be an open-top pouch that is oriented longitudinally on the shoulder strap to which it is coupled.

In some embodiments, the bag may comprise a skin which is a detachable cover for the front of the bag. The skin may be detached from the bag by unzipping a skin zipper. The skin may be replaced with an alternate skin. The alternate skin may be retained by zipping the skin zipper on the alternate skin to couple the alternate skin to the bag. The alternate skin may comprise a different material, coloration, texture, pattern, graphic image, or combinations thereof and may alter the overall appearance of the bag.

In an embodiment, the clip may include one or more locking devices to secure the clip upon the closed bladder nozzle. In non-limiting examples, one or more locking devices may include mini-clips to pinch the clip at one or both ends of the clip, screw-type closures to pinch the clip at one or both ends, and/or zippered closures to pinch the clip and one or both ends. Such mini-clips may apply oppositional pincer forces to further secure the clips in place.

In an embodiment, the open neck of the bladder of the present invention may or may not employ incorporated rails, studs, or other physical surface geometry to aid securing of the clip to the bladder neck.

In an embodiment, the invention may incorporate a screw-top clip with a threaded inlet. Such clips may vary greatly in overall size and threading geometry. Regardless of specific size and threading, the core functionality of the screw-top clip is to employ a threaded male exterior plug to mate with a corresponding female interior receptacle, permitting selective access to a bladder cavity positioned underneath the mating pair. In an embodiment, the screw-top clip sits on the face of the bladder, but may sit upon any bladder surface geometry capable of seating and holding the clip. By way of non-limiting example, the screw-top clip may sit upon the top seam or edge of the bladder. Regardless of its position upon the bladder, when the threaded male exterior plug of the screw-top clip is removed from the corresponding interior female receptacle, fluid may flow through the resulting open cavity into the interior of the bladder. When the male and female clip portions are subsequently mated, the fluid inside the bladder is prevented from flowing out the bladder. In an embodiment, the male and female clip elements are mated and unmated by application of torsional force.

In an embodiment, the invention may include one or more linear mating rails running the width of the open bladder neck. When the neck is open to allow for filling of the bladder, the linear mating rails oppose each other across the open neck. When the user closes the bladder neck, the linear mating rails from either side of the open neck enmesh into a water-resistant or water-tight sealing configuration, preventing the flow of water out of the neck. This enmeshing may be reversed by the user's application of opposing pull force upon each opposing lip of the bladder neck. The bladder neck becomes watertight by the affirmative seating of mating pairs of connectors.

In an embodiment, the bladder neck of the invention may be alternately open and closed using a zipper track that sits upon the top or face of the bladder. In an embodiment, the zipper track may be laser-sealed to the neck to eliminate leakage of fluid from the interior of the bladder. The user may alternately open and close the bladder by application of alternating linear force vectors along the main axis of the zipper.

The invention will now be described by referencing the appended figures representing preferred embodiments.

Turning now to FIG. 1, this figure depicts a front perspective view of one embodiment of the invention 100 shown in the vertical orientation 130. The wearable bag 111 comprises the refill port 112 which, in this embodiment, is located on the right side of the wearable bag 111. The refill port 112 is sealed by a refill zipper 151 which is retained in the closed position by a zipper retainer 157. The wearable bag 111 also comprises the pair of shoulder straps 120 which are located on the top, rear side of the wearable bag 111. The water tube 108 is routed through the interior of the bag 111 and emerges at the top. The water tube 108 extends outside of the wearable bag 111 and terminates at the mouthpiece 109. The water tube 108 is sufficiently long that it may be pulled past the neck of the user and the mouthpiece 109 may be placed into the mouth of the user. The front side of the wearable bag 111 is covered by the skin 175 which is held in place by the skin zipper 154.

Figure 2:
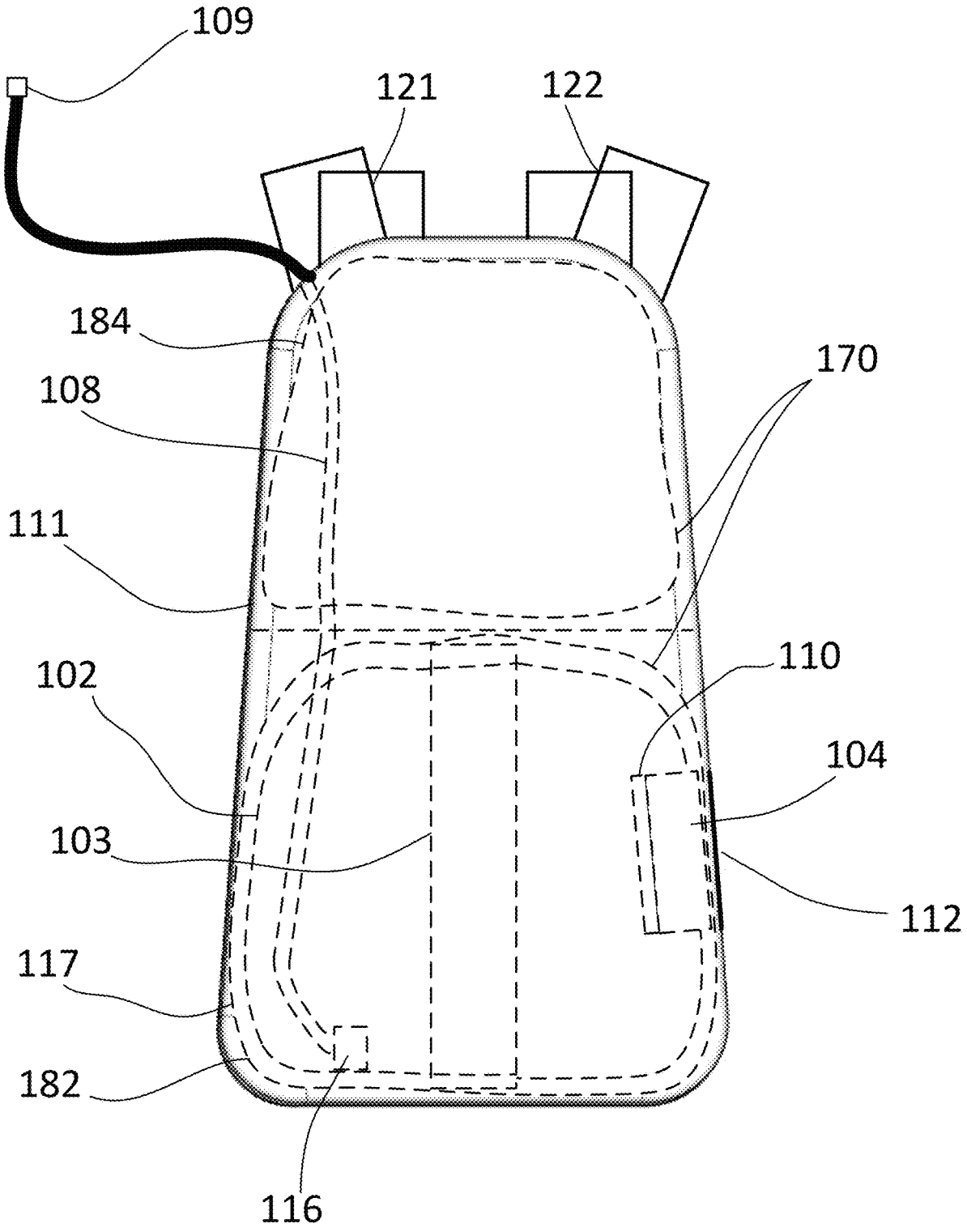
FIG. 2 depicts a front view of an embodiment of the invention illustrating the locations of the fluid bladder and the bladder nozzle.

Turning now to FIG. 2, this figure depicts a front view of the wearable bag 111 with some internal details revealed. In the embodiment shown, the wearable bag 111 comprises two of the one or more compartments 170—specifically the upper compartment 184 and the lower compartment 182. As non-limiting examples, the upper compartment 184 may be used for personal storage by the user and the lower compartment 182 may be the bladder compartment 117. The bladder retention strap 103 may retain the fluid bladder 102 in the bladder compartment 117 when the lower compartment 182 is opened. In the embodiment illustrated by FIG. 2, the bladder nozzle 104 and the clip 110 can be seen at the right side of the bladder compartment 117, adjacent to the refill port 112. Also shown are the outlet 116 at the bottom of the fluid bladder 102, the water tube 108 that is coupled to the outlet 116 and routed through the wearable bag 111 to an exit at the top of the wearable bag 111, and the mouthpiece 109 at the upper end of the water tube 108. The left strap 121 and the right strap 122 are coupled to the rear of the wearable bag 111, are visible at the top of the wearable bag 111 in this view.

Figure 3:
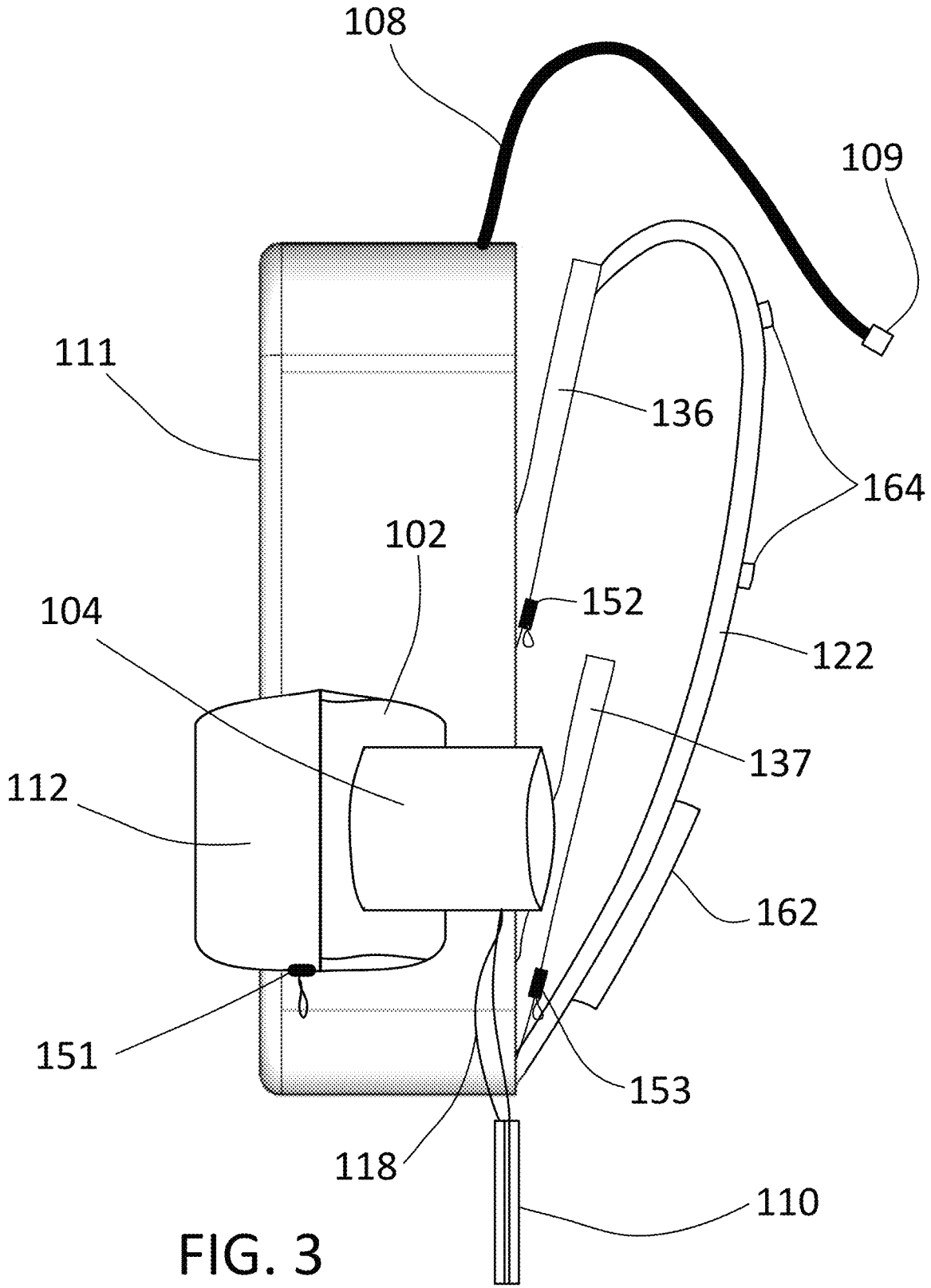
FIG. 3 depicts a side view of an embodiment of the invention illustrating the refill port on the side opened and the bladder nozzle extended with the clip removed.

Turning now to FIG. 3, this figure depicts a side view of an embodiment of the wearable bag 111. In this view, the water tube 108 leading to the mouthpiece 109 can be seen emerging from the top rear of the wearable bag 111. The upper compartment port 136 and the lower compartment port 137 on the rear of the wearable bag 111 are shown opened. The upper compartment port 136 may be opened by unzipping an upper compartment zipper 152 and the lower compartment port 137 may be opened by unzipping a lower compartment zipper 153. This figure illustrates the coupling of the top of the right strap 122 to the top of the upper compartment port 136. The top of the left strap likewise couples to the top of the upper compartment port 136 on the left side of the upper compartment port 136 but is not visible in this figure. The refill port 112 has been opened using the refill zipper 151. The bladder nozzle 104 has been extended away from the fluid bladder 102 and the clip 110 has been removed. The clip 110 is retained by a clip retainer 118. This figure illustrates positioning of elements and is not intended to demonstrate usage—ordinarily the clip 110 would not be removed from the bladder nozzle 104 while the wearable bag 111 is in the vertical position. A device pocket 164 located on the right shoulder strap 122 may hold an electronic device and cables from the electronic device may be retained by a plurality of cable straps 164 also located on the right shoulder strap 122. A similar pocket and additional cable straps may be provided on the left shoulder strap. As a non-limiting example, the electronic device may be an EL wire driver and the cable may be an EL wire coupled to the EL wire driver.

Figure 4A:
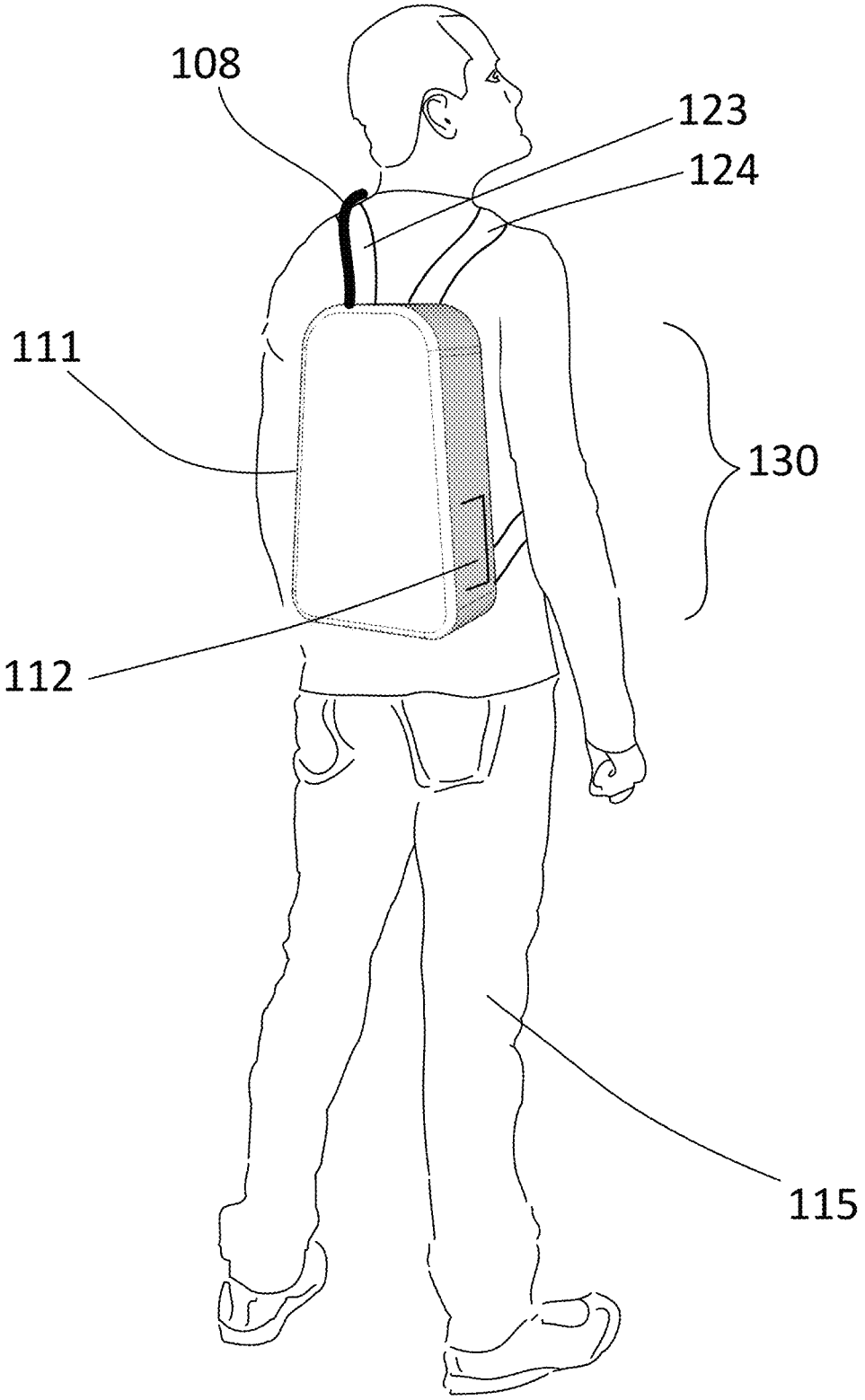
FIG. 4A depicts an in-use view of an embodiment of the invention illustrating the bag in the vertical orientation and the water tube in position for the user to drink a fluid from the fluid bladder.

Turning now to FIG. 4A, this figure depicts an in-use view of the invention during normal use. The wearable bag 111 is in the vertical orientation 130 and the water tube 108 is pulled around to the mouth of the user 115 so that the user 115 may drink the fluid via the water tube 108. The wearable bag 111 is supported on the user's back by the first shoulder strap 123 and the second shoulder strap 124. The location of the refill port 112 can be seen on the right side of the wearable bag 111.

Figure 4B:
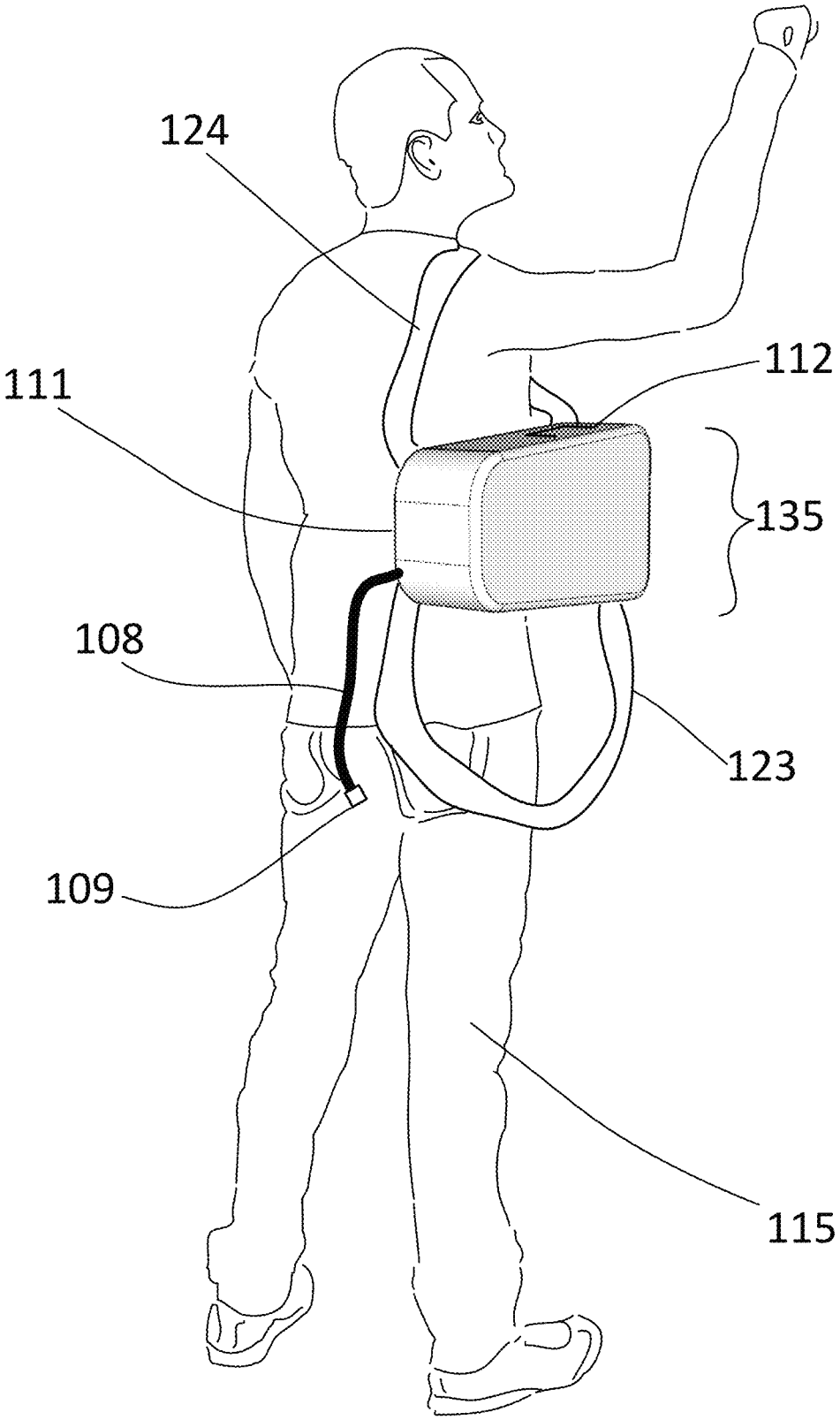
FIG. 4B depicts an in-use view of an embodiment of the invention illustrating the bag swung to the horizontal orientation in preparation for refilling.

Turning now to FIG. 4B, this figure depicts an in-use view of the invention during a first stage of refilling the bladder. For this figure, the left arm has been removed from the first shoulder strap 123 and the wearable bag 111 has been swung into the horizontal orientation 135 under the right arm—hanging from the second shoulder strap 124 only. By placing the wearable bag 111 in the horizontal orientation 135, the user 115 has positioned the refill port 112 at the top of the wearable bag 111. The water tube 108 and the mouthpiece 109 are not needed during refilling and are left dangling.

Figure 4C:
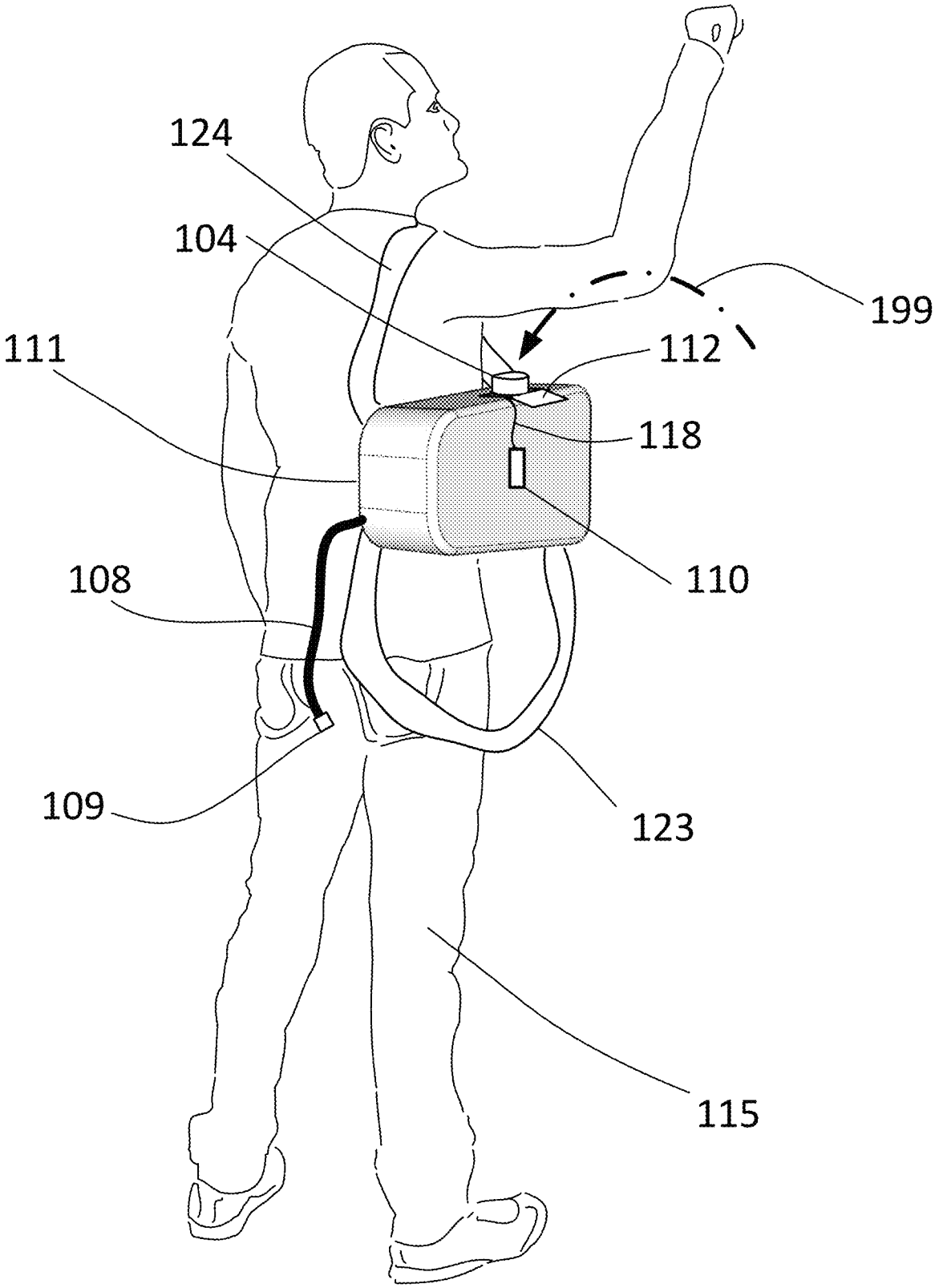
FIG. 4C depicts an in-use view of an embodiment of the invention illustrating the bag in the horizontal orientation with the refill port open and the bladder nozzle extended—ready to refill.

Turning now to FIG. 4C, this figure depicts an in-use view of the invention during a final stage of refilling the bladder. The wearable bag 111 remains in the horizontal orientation, hanging by the second shoulder strap 124, and the first shoulder strap 123 may be left dangling. The user 115 has opened the refill port 112 and extended the bladder nozzle 104. The clip 110 has been removed and the bladder nozzle 104 is ready to accept a flow of fluid 199 that will refill the bladder. As a non-limiting example, the flow of fluid 199 may be provided by a hydration station available at a venue. The clip 110 may be retained by the clip retainer 118. Once the bladder is full, the bladder nozzle 104 may be folded and the clip 110 may be slid onto the bladder nozzle 104 to seal the bladder nozzle 104. The bladder nozzle 104 and the clip 110 may then be placed back inside the wearable bag 111, the refill port 112 may be closed, and the left arm may be passed through the first shoulder strap 123 to pull the wearable bag 111 onto the user's back, supported by the user's shoulders. The water tube 108 and the mouthpiece 109 are not needed during refilling and are left dangling.

Figure 5:
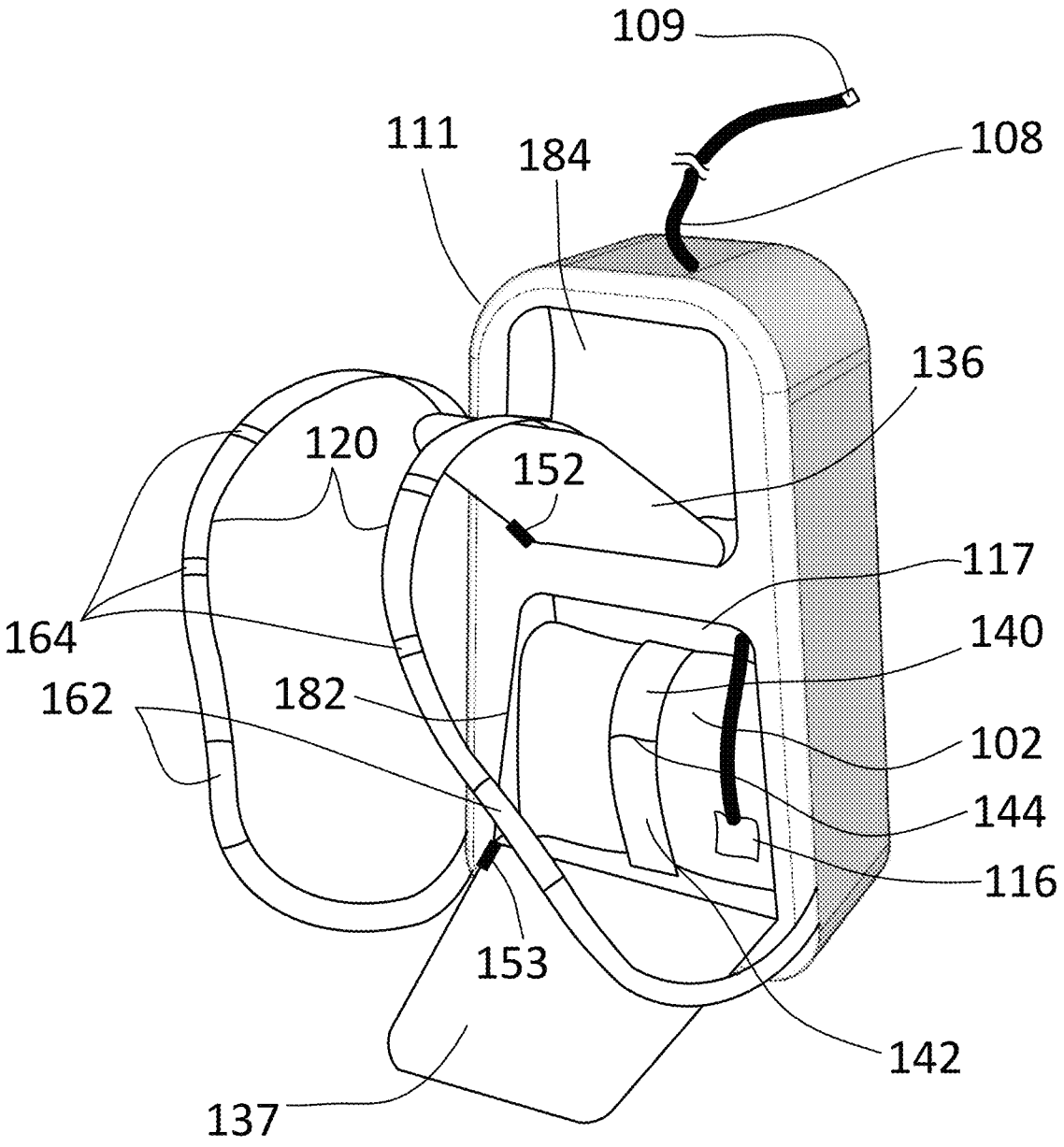
FIG. 5 depicts a rear perspective view of an embodiment of the invention illustrating the upper and lower compartments opened for access.

Turning now to FIG. 5, this figure depicts a rear perspective view of the invention to illustrating access to the upper compartment 184 and to the lower compartment 182. The upper compartment port 136 has been opened by unzipping the upper compartment zipper 152 to expose the interior of the upper compartment 184. The lower compartment port 137 has been opened by unzipping the lower compartment zipper 153 to expose the interior of the lower compartment 182. Both the upper compartment port 136 and the lower compartment port 137 are on the rear of the wearable bag 111 and therefore may not be accessed unless the user removes the wearable bag 111 from their back—this results in more secure compartments. The fluid bladder 102 can be seen in the bladder compartment 117, retained by the first strap portion 140 and the second strap portion 142. In the embodiment shown, the first strap portion 140 and the second strap portion 142 may be decoupled at the retention strap fastener 144 in order to remove the fluid bladder 102. The figure also illustrates how the top end of the pair of shoulder straps 120 coupled to the top of the upper compartment port 136 and the bottom ends of the pair of shoulder straps 120 couple to the wearable bag 111. The figure also illustrates the water tube 108 routed through the wearable bag 111 from the outlet 116 at the bottom of the fluid bladder 102 to the mouthpiece 109 located outside of the wearable bag 111. One or more device pockets 162 may be located on the bottom half of the shoulder straps 120 with a plurality of cable straps 164 coupled to the shoulder straps 120 above the device pockets 162.

Figure 6:
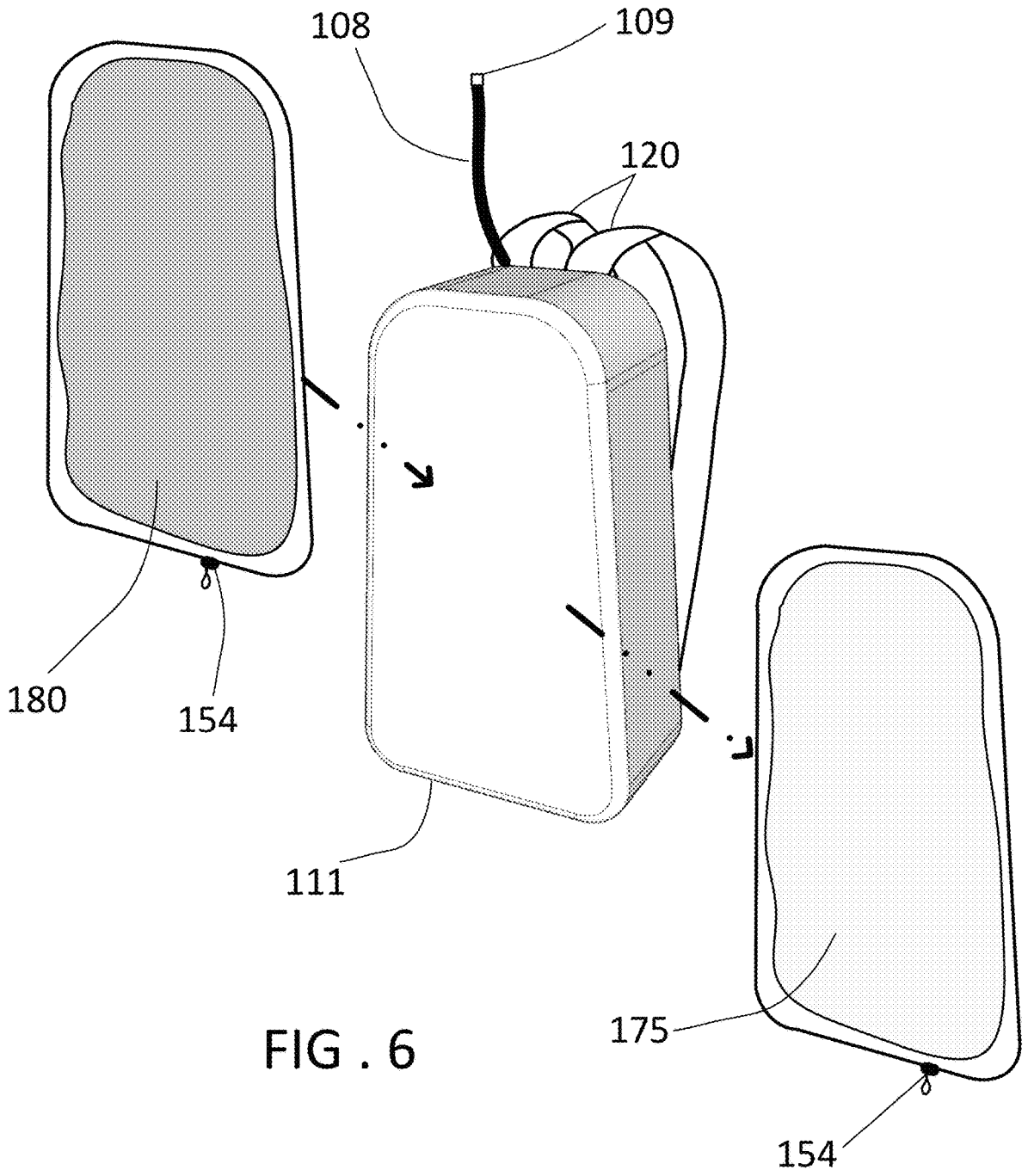
FIG. 6 depicts a detail view illustrating replacement of the skin.

Turning now to FIG. 6, this figure depicts details related to replacement of the skin 175. In an embodiment, the skin 175 may be separably connected to an additional layer that has insulating properties and is constructed of a waterproof material to prevent against rain penetration and guard against heat penetration from the environment that may raise the temperature of the bladder in the insulated compartment. As illustrated, the skin 175 has been removed from the front of the wearable bag 111 by unzipping the skin zipper 154 on the skin 175. The alternate skin 180 may now be placed on the front of the wearable bag 111 and the skin zipper 154 on the alternate skin 180 may be zipped to hold the alternate skin 180 in place. The pair of shoulder straps 120, the water tube 108, and the mouthpiece 109 are illustrated and it can be seen that they do not interfere with replacement of the skin 175.

Figure 7:
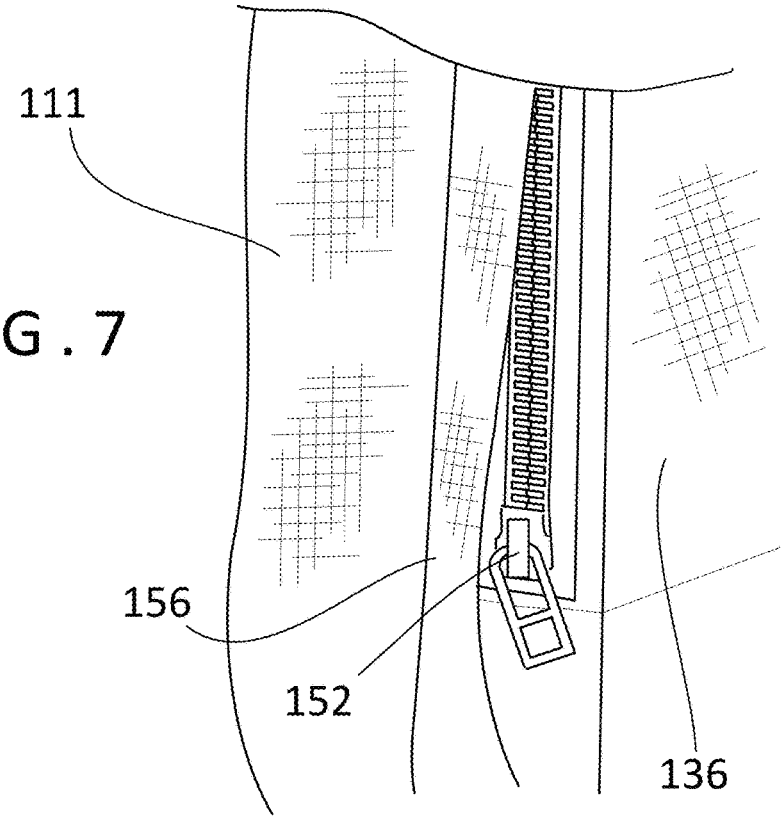
FIG. 7 depicts a detail view illustrating the zipper cover flap pulled back to expose the upper compartment zipper.

Turning now to FIG. 7, this figure depicts details of a zipper cover flap 156. The zipper cover flap 156 surrounds the rear edge of the sides and top of the wearable bag 111 to cover the upper compartment zipper 152 and the lower compartment zipper. Only the upper compartment zipper 152 is illustrated here. In the figure, the zipper cover flap 156 has been pulled back to reveal the upper compartment zipper 152, which may now be unzipped so that the upper compartment port 136 may be opened. Covering the upper compartment zipper 152 and the lower compartment zipper with the zipper cover flap 156 provides increased security because the end of the zipper cover flap 156 that must be lifted is adjacent to the user's back.

Figure 8:
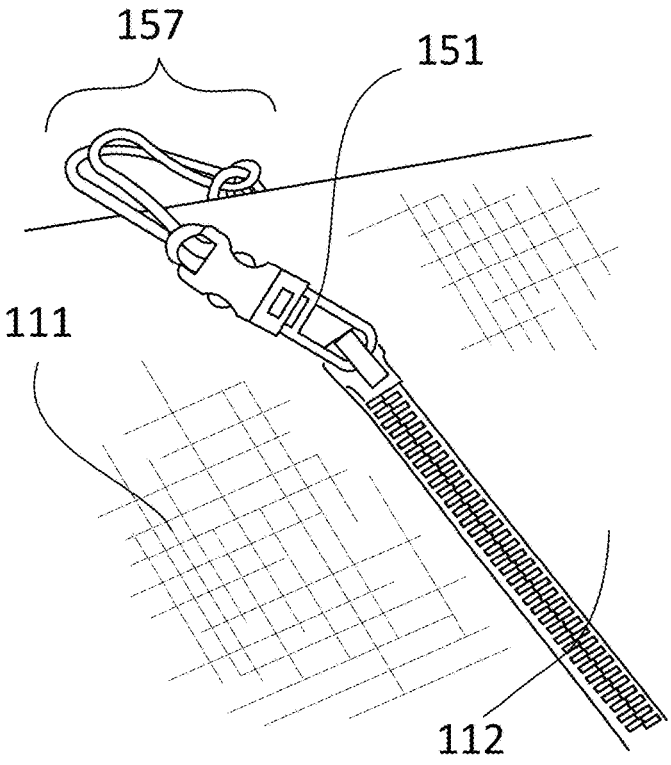
FIG. 8 depicts a detail view illustrating the zipper retainer that prevents the refill zipper from opening unintentionally.

Turning now to FIG. 8, this figure depicts details related to the zipper retainer 157. The zipper retainer 157 prevents the refill zipper 151 from opening inadvertently. With the refill zipper 151 zipped to close the refill port 112, the refill zipper 151 may be slid into the zipper retainer 157 which is coupled to the wearable bag 111. With the zipper retainer 157 and the refill zipper 151 so coupled, the refill zipper 151 may not unzip. Decoupling the refill zipper 151 from the zipper retainer 157 may require an explicit action on the part of the user. As a non-limiting example, decoupling the refill zipper 151 from the zipper retainer 157 may require the user to squeeze the sides of the zipper retainer 157 while pulling on the refill zipper 151.

Figure 9A:
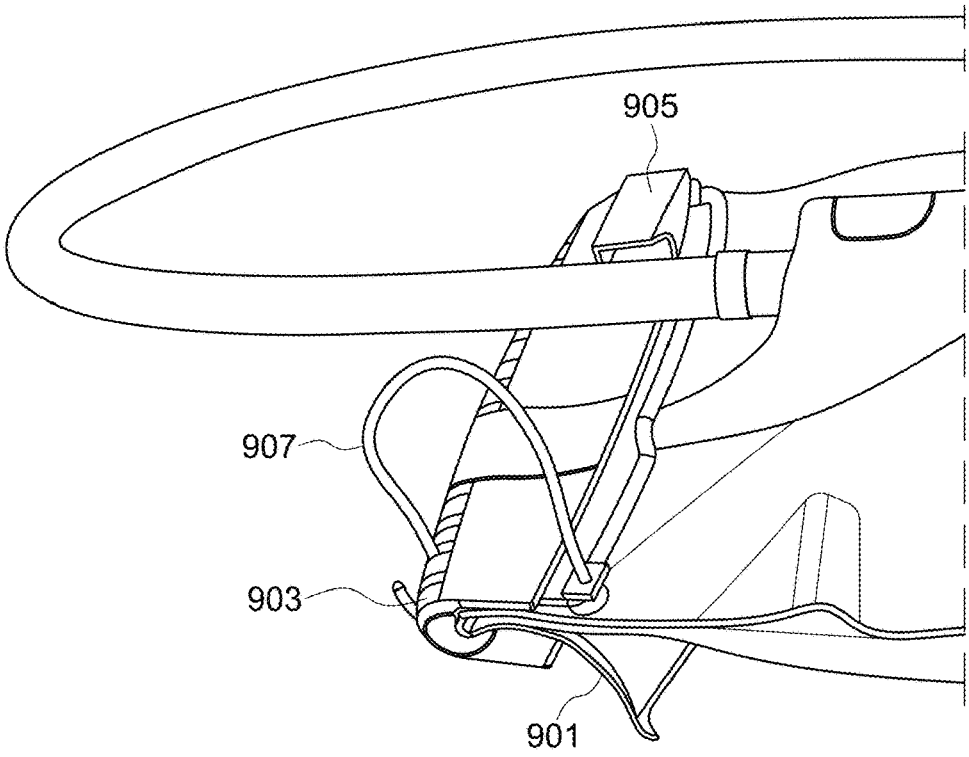
FIG. 9A depicts a bladder clip with a lock securing the bladder clip to the bladder neck.

Turning now to FIG. 9A, this figure depicts a bladder clip with a lock securing the bladder clip to the bladder neck. Bladder neck 901 is folded upon itself, with bladder clip 903 pinching the folded edge of the bladder neck 901. Bladder clip lock 905 in turn pinches the opposing edges of bladder clip 903 to further secure bladder clip 903 to bladder neck 901. Lanyard-type clip retainer 907 is attached to the bladder clip 903 at one end and bladder neck 901 at the opposite end. To release the bladder clip 903 from the bladder neck 901, a user repositions bladder clip lock 905 to reduce or eliminate the pinch force applied to bladder clip 903 by bladder clip lock 905. (Operation not shown.)

Figure 9B:
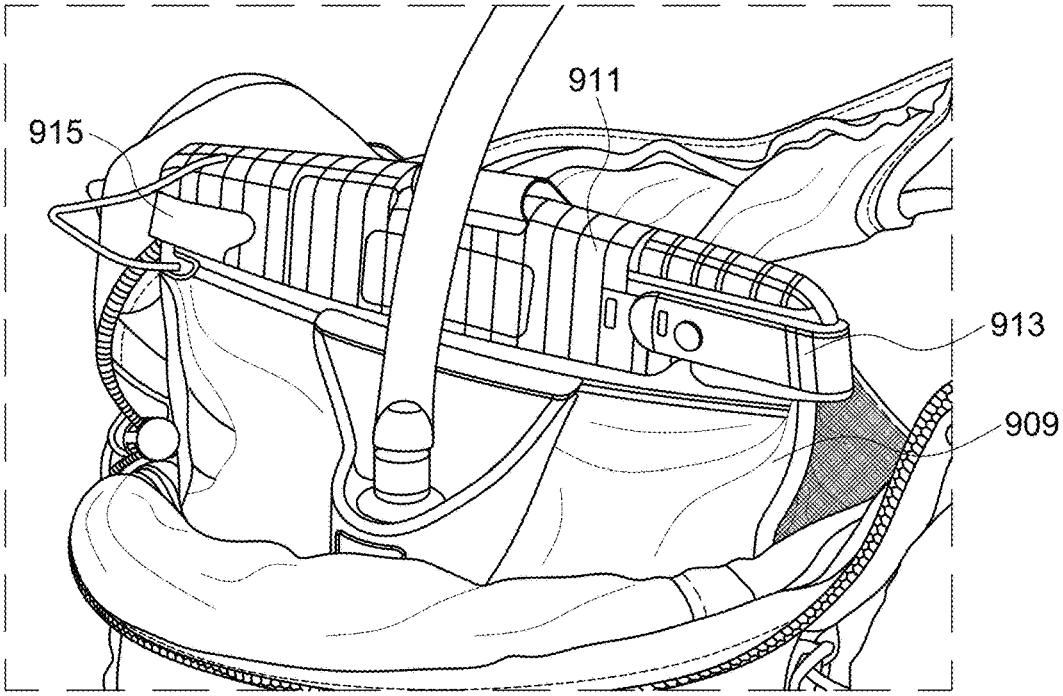
FIG. 9B depicts a bladder clip with two locks securing the bladder clip to the bladder neck, the bladder having been inserted into a compartment of the corresponding bag.

Turning now to FIG. 9B, this figure depicts a bladder clip with two locks securing the bladder clip to the bladder neck, the bladder having been inserted into a compartment of the corresponding bag. Bladder neck 909 is folded upon itself, and bladder clip 911 is shown pinching opposing sides of the bladder neck 909. First bladder clip lock 913 and second bladder clip lock 915 pinch the two ends of bladder clip 911 to further secure bladder clip 911 to bladder neck 909.

Figure 10A:
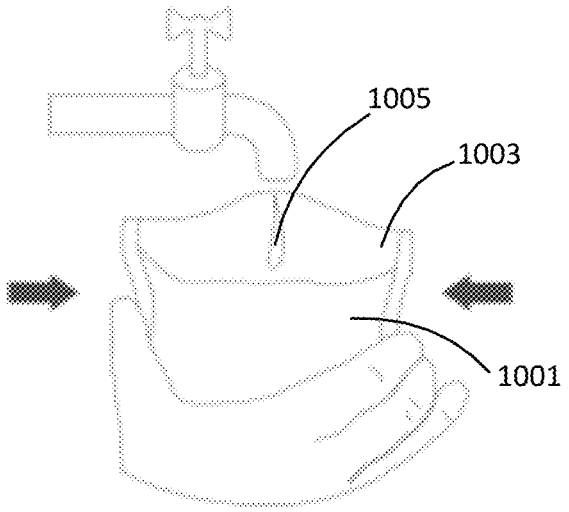
FIG. 10A depicts Step One to securely filling the fluid bladder consistent with certain embodiments of the present invention.

Turning now to FIG. 10A, this figure depicts Step One to securely filling the fluid bladder consistent with certain embodiments of the present invention. User's application of pincer forces (as represented by arrows) upon opposite seams of bladder 1001 causes bladder neck 1003 to open to an extent sufficient to allow fluid flow 1005 into the bladder 1001.

Figure 10B:
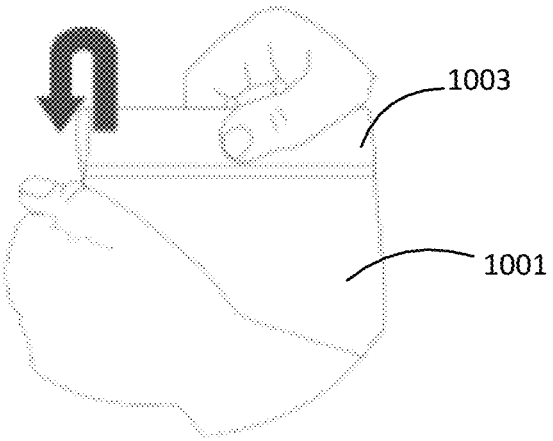
FIG. 10B depicts Step Two to securely filling the fluid bladder consistent with certain embodiments of the present invention.

Turning now to FIG. 10B, this figure depicts Step Two to securely filling the fluid bladder consistent with certain embodiments of the present invention. To close the bladder 1001, user folds the bladder neck 1003 upon itself in a motion, the direction of which is represented by the arrow.

Figure 10C:
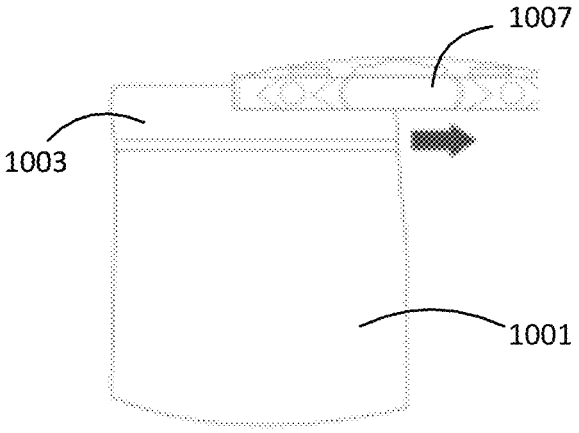
FIG. 10C depicts Step Three to securely filling the fluid bladder consistent with certain embodiments of the present invention.

Turning now to FIG. 10C, this figure depicts Step Three to securely filling the fluid bladder consistent with certain embodiments of the present invention. To secure the fold in the bladder neck 1003, user slides bladder clip 1007 upon the folded bladder neck 1003. Bladder 1001, relative to bladder clip 1007, moves in the direction of the arrow shown. The bladder 1003 neck may or may not be configured with surface geometry to guide and/or to further secure the placement of the bladder clip 1007.

Figure 11A:
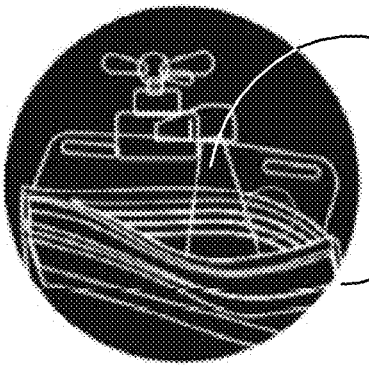
FIG. 11A re-depicts Step One to securely filling the fluid bladder consistent with certain embodiments of the present invention.

Turning now to FIG. 11A, this figure depicts Step One to securely filling the fluid bladder consistent with certain embodiments of the present invention. User's application of pincer forces upon opposite seams of bladder 1101 causes bladder neck 1103 to open to an extent sufficient to allow fluid flow 1105 into the bladder 1101.

Figure 11B:
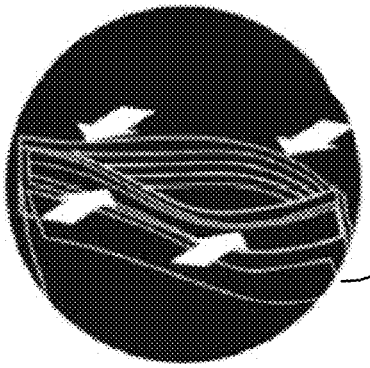
FIG. 11B depicts Alternate Step Two to securely filling the fluid bladder consistent with certain embodiments of the present invention.

Turning now to FIG. 11B, this figure depicts Alternate Step Two to securely filling the fluid bladder consistent with certain embodiments of the present invention. To close the bladder neck 1103, user applies opposing forces (as represented by arrows) to opposite edges of the bladder neck 1103, such opposing forces sufficient to mate connectors (not shown) on the inside of opposite edges of the bladder neck 1003.

Figure 11C:
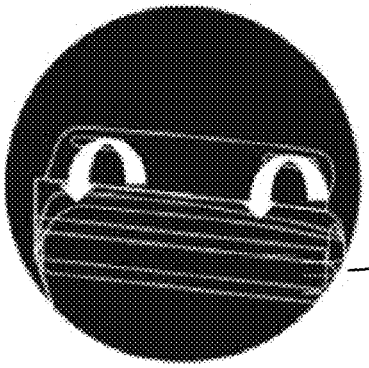
FIG. 11C depicts Alternate Step Three to securely filling the fluid bladder consistent with certain embodiments of the present invention.

Turning now to FIG. 11C, this figure depicts Alternate Step Three to securely filling the fluid bladder consistent with certain embodiments of the present invention. The edges of the bladder neck 1103 now being mated, the user folds over and secures the bladder neck 1103 upon itself, utilizing a motion represented by the arrows.

While all figures presented visualize the alignment of the hydration system to the right side, the hydration system may be reversed in an embodiment in which the protrusion of the bladder nozzle 104 through the refill port 112 may be on either wall of the wearable bag 111 such that a left-handed or right-handed person could access the refill port 112 on their dominant side.

While the embodiments presented in this document have described the use of zippers to seal the refill port 112, the upper compartment port 136, and the lower compartment port 137, alternative embodiments that use magnets, clips, snaps, buttons, other fasteners, or combinations thereof are envisioned and are considered to be within the scope and spirit of the present invention.

While the embodiments presented in this document have described the refill port 112 on one side of the wearable bag 111 only, embodiments with the refill port 112 on either or both side of the wearable bag 111 are envisioned and are considered to be within the scope and spirit of the present invention.

While preferred materials for elements have been described, the device is not limited by these materials. Wood, plastics, rubber, foam, metal alloys, aluminum, and other materials may comprise some or all of the elements of the hydration system and apparatuses in various embodiments of the present invention.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

While certain illustrative embodiments have been described, it is evident that many alternatives, modifications, permutations and variations will become apparent to those skilled in the art in light of the foregoing description.

What is claimed is:

1. A hydration bladder refill system comprising:

a fluid bladder associated with a bag and having a bladder nozzle;

where the fluid bladder is a vessel for carrying a fluid and contained within a compartment of a wearable bag;

said bladder nozzle being an opening into said fluid bladder and configured to be securely closed by being first flattened and then folded;

a bladder clip attached to the bladder neck of said bladder nozzle, and further attached to said flattened and folded bladder nozzle utilizing a lanyard connector;

said bladder clip closed upon said bladder neck through pinch force closing said bladder neck by forcing the opposite sides of said bladder neck into contact;

said bladder clip further comprising a first bladder clip lock and a second bladder clip lock positioned to pinch the distal end and the proximal end respectively of said bladder clip to further secure said bladder clip to said bladder neck;

where said flattened and folded bladder nozzle is secured in a closed position by said attached clip, and is completely enclosed in a compartment of the wearable bag when said bladder nozzle is secured in said closed position;

where the bladder nozzle is an inlet at the proximal portion of said fluid bladder for introducing the fluid into the fluid bladder;

where the wearable bag comprises said bag compartment from which said fluid bladder extends to permit opening of the bladder nozzle exterior to said bag compartment;

where a pair of shoulder straps attached to the wearable bag are adapted to be worn over a user's shoulders such that a user carries the wearable bag on a user's back;

where the fluid bladder is connected at a distal end of said bag compartment to a water tube;

where the fluid bladder is retained in a bag compartment and said fluid bladder is retained within said bag compartment when said bag is placed in a horizontal orientation to facilitate refilling of said fluid bladder.

2. The system according to claim 1 where a refill port selected from the one or more fabric ports is located on a side of the bag;

where the refill port provides access to the bladder nozzle when the bag is placed in a horizontal orientation.

3. The system according to claim 1 where a first shoulder strap is adapted to be removed from the user's shoulder to reorient the bag;

where a second shoulder strap is adapted to suspend the bag at user's side when the bag is in a horizontal orientation.

4. The system according to claim 1 where the clip compresses the bladder nozzle by pressing against both sides of the bladder nozzle at a fold in the bladder nozzle.

5. The system according to claim 1, further comprising one or more locking devices for securing the clip.

6. The system according to claim 5 where the one or more locking devices employ pinch forces upon the clip to secure each locking device in a closed position.

7. The system according to claim 1 where the bladder nozzle opening is made watertight by mating pairs of connectors such that they are in contact with one another and folded forming a water tight seal.

8. The system according to claim 1, further comprising an exterior skin;

where said exterior skin is detached from a front side of the bag;

where an alternate exterior skin is attached to said front side of the bag;

where the exterior skin and the alternate exterior skin differ in composition, coloration, texture, pattern, graphic imagery, or combinations thereof.

9. The system according to claim 1 further comprises an outlet, a water tube and a mouthpiece;

where the outlet couples a bottom end of the water tube to a bottom end of the fluid bladder for the purpose of removing the fluid from the fluid bladder;

where the water tube transports the fluid from the outlet to the mouthpiece;

where the mouthpiece is adapted to be placed into the user's mouth such that the user siphons the fluid from the fluid bladder.

10. The system according to claim 1 further comprising a bladder retention strap;

where the bladder retention strap restrains the fluid bladder within the bladder compartment.

11. The system according to claim 10 where the bladder retention strap comprises a first strap portion and a second strap portion that couple to each other and decouple from each other at a retention strap fastener.

12. The system according to claim 1 further comprising one or more device pockets and a plurality of cable straps coupled to the pair of shoulder straps;

where the one or more device pockets are open-top pouches oriented longitudinally to the shoulder straps;

where the plurality of cable straps are flexible straps oriented laterally across the shoulder straps;

where the plurality of cable straps are located above the one or more device pockets.

* * * * *